US011060539B2

(12) United States Patent
Li

(10) Patent No.: US 11,060,539 B2
(45) Date of Patent: Jul. 13, 2021

(54) DEVICE HAVING HYBRID HYDRAULIC-ELECTRIC ARCHITECTURE

(71) Applicant: Regents of the University of Minnesota, Minneapolis, MN (US)

(72) Inventor: Perry Yan-Ho Li, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 16/781,446

(22) Filed: Feb. 4, 2020

(65) Prior Publication Data

US 2020/0248729 A1 Aug. 6, 2020

Related U.S. Application Data

(60) Provisional application No. 62/801,137, filed on Feb. 5, 2019, provisional application No. 62/883,724, filed on Aug. 7, 2019.

(51) Int. Cl.
*F15B 21/14* (2006.01)
*F15B 15/20* (2006.01)

(52) U.S. Cl.
CPC ..... *F15B 21/14* (2013.01); *F15B 2015/206* (2013.01); *F15B 2211/20515* (2013.01); *F15B 2211/20569* (2013.01); *F15B 2211/6651* (2013.01)

(58) Field of Classification Search
CPC .. F15B 21/14; F15B 2015/206; F15B 11/024; F15B 2211/20515; F15B 2211/20569; F15B 2211/88
See application file for complete search history.

(56) References Cited

U.S. PATENT DOCUMENTS 5,174,724 A * 12/1992 Ammons ..... F03D 13/20 417/35
5,794,441 A * 8/1998 Lisniansky ..... F04B 49/08 60/414
6,854,268 B2 * 2/2005 Fales ..... F15B 1/024 60/414
8,161,741 B2 * 4/2012 Ingersoll ..... F02C 6/16 60/425

(Continued)

OTHER PUBLICATIONS

L. Love, E. Lanke, and P. Alles, "Estimating the Impact (Energy, Emissions and Economics) of the US Fluid Power Industry," DOE Oak Ridge National Laboratory, ORNL/TM-2011/14, 2012.

(Continued)

*Primary Examiner* — Thomas E Lazo
(74) *Attorney, Agent, or Firm* — Brian D. Kaul; Westman, Champlin & Koehler, P.A.

(57) ABSTRACT

A device having a hybrid hydraulic-electric architecture includes a hydraulic pump/motor having first and second ports, and an electric motor. The device is configured to connect to two or more pressure rails, each pressure rail containing hydraulic fluid at a different pressure than the other pressure rails. A flow of hydraulic fluid from one of the pressure rails is driven through the hydraulic pump/motor, and a pressure difference exists between the first and second ports. The electric motor is configured to control a flow rate of the flow of hydraulic fluid and/or the pressure difference.

20 Claims, 5 Drawing Sheets

(56) References Cited

U.S. PATENT DOCUMENTS

| | | | | |
|---|---|---|---|---|
| 8,186,154 | B2 * | 5/2012 | Nelson | F15B 21/14 60/414 |
| 8,272,212 | B2 * | 9/2012 | Blieske | F02C 6/16 60/408 |
| 9,260,835 | B2 * | 2/2016 | Kang | E02F 9/2217 |
| 9,982,657 | B2 * | 5/2018 | Qiu | F03D 9/12 |
| 2016/0102685 | A1 * | 4/2016 | Chester | F15B 7/006 60/327 |
| 2017/0002845 | A1 * | 1/2017 | Lesage | B64C 13/341 |
| 2017/0198730 | A1 * | 7/2017 | Owada | F03C 1/053 |

OTHER PUBLICATIONS

P. J. Gagnon, "Configuration and Performance of Hydraulic Transformer Power Distribution Systems," Masters—A, Mech. Eng., University of Minnesota, 2016.

M. Vukovic, et al. "Steam—A Mobile Hydraulic System with Engine Integration," in Proceedings of the ASME/BATH 2013 Symposium on Fluid Power & Motion Control FPMC2013 Oct. 6-9, 2013, Sarasota, Florida, USA.

R. Hippalgaonkar and M. Ivantysynova, "Fuel savings of a mini-excavator through a hydraulic hybrid displacement controlled system," in Proceedings of the 8th International Conference on Fluid Power (IFK), Dresden, Germany, 2012.

S. Helduser, "Electric-hydrostatic drive—an innovative energy-saving power and motion control system," Proceedings of the Institution of Mechanical Engineering—Part I, vol. 213, pp. 427-437, 1999.

* cited by examiner

DEVICE HAVING HYBRID HYDRAULIC-ELECTRIC ARCHITECTURE

CROSS-REFERENCE TO RELATED APPLICATION

The present application is based on and claims the benefit of U.S. provisional patent application Ser. No. 62/801,137, filed Feb. 5, 2019, and claims the benefit of U.S. provisional patent application Ser. No. 62/883,724, filed Aug. 7, 2019, the content of each of these provisional applications is hereby incorporated by reference in its entirety.

GOVERNMENT FUNDING

This invention was made with government support under DE-EE0008384 awarded by the U.S. Department of Energy National Energy Technology Laboratory. The government has certain rights in the invention.

FIELD

Embodiments of the present disclosure generally relate to hybrid hydraulic and electric devices for powering movement of a load, and/or for capturing energy from a load to generate electricity.

BACKGROUND

Conventional mobile machines, such as excavator, skid-steer/wheel loaders, and mowers, have multiple degrees-of-freedom and primarily use hydraulics for power transmission due to its unsurpassed power density.

One conventional architecture for providing hydraulic power transmission in a multi degree-of-freedom system is a load-sensing (LS) system in which a pressure compensated pump provides a common pressure at a level that is slightly higher than the highest pressure requirement of all the services. Throttling valves are then used to drop the pressure to the required pressure of the services. This circuit can only be efficient if all services require nearly the same pressure levels (which is not true of most systems), so that the pressure drops are kept low. However, significant throttling energy losses are incurred in typical systems, where the required instantaneous pressures differ significantly. Moreover, energy from over-running loads is typically not recaptured due to the mismatch in pressure of the accumulator and at the load.

A potentially more efficient approach to throttling a common pressure rail supplied by a centralized hydraulic power supply, is to utilize a hydraulic transformer to conservatively buck or boost the common pressure rail pressure to the required pressure. This approach is throttle-less and regenerative, and can potentially improve efficiencies. However, hydraulic transformers are generally not commercially available, are bulky, and have limited practical transformation ratios. Their efficiencies also decrease at partial loads since the constituent pump/motors tend to be inefficient at low effective displacements.

An electrical approach to improving efficiency is to utilize an electro-hydraulic actuator setup, in which an electric motor is used to drive a fixed or variable displacement hydraulic pump/motor to control the flow rate to a single actuator. Besides being throttle-less, regenerative, and efficient, it also has good control performance. High control performance stems from the ability to adjust the torque virtually instantaneously, so as to control the speed of the hydraulic pump and to precisely control the flow in and out of the hydraulic actuator. However, because all power is provided electrically, high power electric drives, which are prohibitive in cost and size, are needed. Therefore, the electro-hydraulic actuator approach is currently only practical for low-power machines.

SUMMARY

Embodiments of the present disclosure are directed to a device that combines hydraulic and electric means of actuation to form a hybrid hydraulic-electric architecture, a system utilizing at least one of the devices, and a method of operating the system. In one embodiment, the device is configured to connect to two or more pressure rails, each pressure rail containing hydraulic fluid at a different pressure than the other pressure rails. The device includes a hydraulic pump/motor having first and second ports, and an electric motor. A flow of hydraulic fluid from one of the pressure rails is driven through the hydraulic pump/motor, and a pressure difference exists between the first and second ports. The electric motor is configured to control a flow rate of the flow of hydraulic fluid and/or the pressure difference.

One embodiment of the system includes two or more pressure rails, each containing hydraulic fluid at a different pressure than the other pressure rails and a first devices. The first device includes a first hydraulic pump/motor having first and second ports, and a first electric motor. A first flow of hydraulic fluid from one of the pressure rails is driven through the first hydraulic pump/motor, and a first pressure difference exists between the first and second ports of the first hydraulic pump/motor. The first electric motor is configured to control a flow rate of the first flow and/or the first pressure difference. The first electric motor includes a motor mode, in which the first electric motor increases the flow rate of the first flow or increases the first pressure difference, and/or a generator mode, in which the first electric motor decreases the flow rate of the first flow or decreases the first pressure difference.

One embodiment of the method is directed to the operation of a system having two or more pressure rails, each containing hydraulic fluid at a different pressure than the other pressure rails, and a device including a hydraulic pump/motor having first and second ports, and an electric motor. In the method, a flow of hydraulic fluid is driven from one of the pressure rails through the hydraulic pump/motor, and a pressure difference exists between the first and second ports. A flow rate of the flow of hydraulic fluid and/or the pressure difference is controlled using the electric motor by operating the electric motor in a motor mode, in which the electric motor increases the flow rate of the hydraulic fluid flow or increases the pressure difference, and/or operating the electric motor in a generator mode, in which the electric motor decreases the flow rate of the hydraulic fluid flow or decreases the first pressure difference.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DESCRIPTION OF ILLUSTRATIVE EMBODIMENTS

Embodiments of the present disclosure are described more fully hereinafter with reference to the accompanying drawings. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Embodiments of the present disclosure include a system architecture for combining the merits of electric and hydraulic technologies, such as for mobile machineries with multiple degrees of freedom, traditionally actuated by hydraulics. The architecture is both highly energy efficient and controllable by exploiting the respective strengths of hydraulics actuation (such as power density) and electric actuation (such as controllability, efficiency and energy dense storage in batteries), while minimizing their respective weaknesses. The major weaknesses of hydraulic actuation are the relatively low component efficiency and that increasing system efficiency is often accompanied by decrease in control performance or increase in system complexity and bulkiness. The primary weakness of electric actuation is that high power and high torque electric machines are expensive, heavy, and bulky, and hence not appropriate for high power mobile machines. The latter limitation is due to the challenge to generate and maintain a large magnetic field to develop high force/torque. In contrast, for large scale systems, hydraulics is one to two orders of magnitude more power dense and torque/force dense than electric actuation.

Embodiments of the present disclosure enable throttleless and regenerative flow control using electric drives while the majority of power is provided hydraulically. Thus, the disclosed embodiments provide an efficient and practicable architecture that leverages the comparative advantages of electric and hydraulic technologies. Embodiments of the present disclosure may also be used to recapture energy utilized by a system, or capture renewable energies, such as wind energy, wave energy, and other renewable energies.

Figure 1:
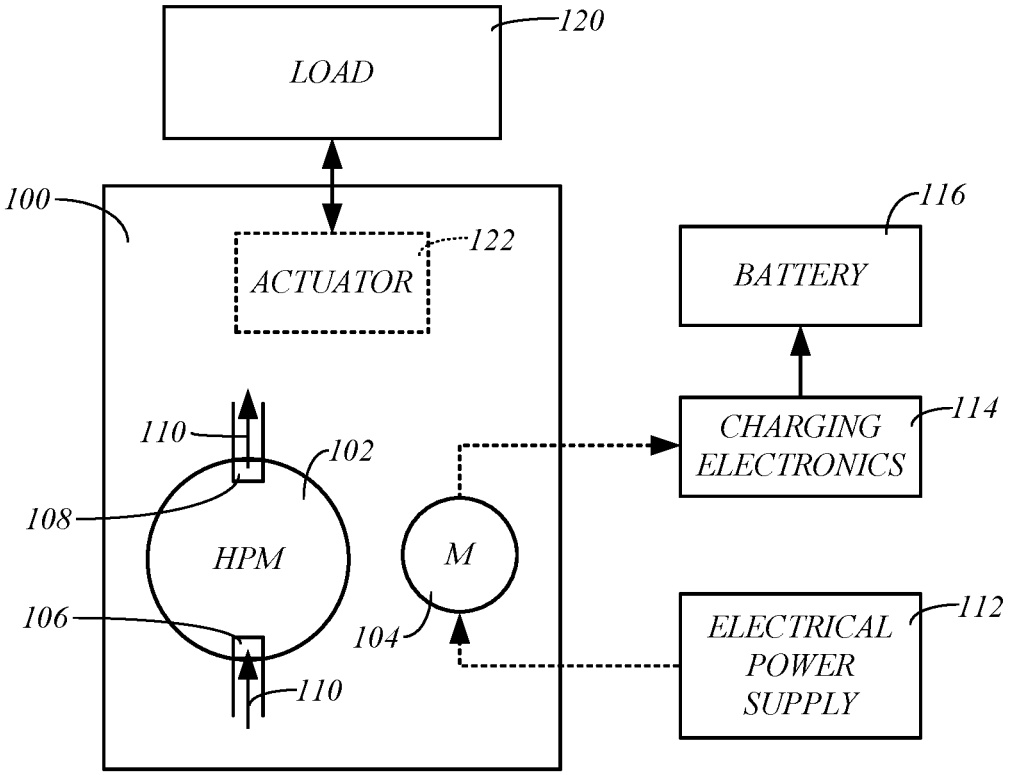
FIG. 1 is a simplified diagram of a device having a hybrid hydraulic-electric architecture in accordance with embodiments of the present disclosure.

A simplified diagram of a device 100 having a hybrid hydraulic-electric architecture in accordance with embodiments of the present disclosure is illustrated in FIG. 1. The device 100 includes a conventional hydraulic pump/motor (HPM) 102 and a conventional electric motor (e.g., permanent magnet alternating current synchronous motor) 104. In some embodiments, the device 100 does not include throttle valves. Rotors and other conventional features of the HPM 102 and the motor 100 are not shown in order to simplify the illustrations.

The HPM 102 may comprise a hydraulic pump or motor having a first port 106 and a second port 108. A flow 110 of hydraulic fluid travels or is driven through the HPM 102. A pressure difference between the ports 106 and 108 is developed in relation to the hydraulic fluid flow 110. The hydraulic fluid flow 110 may be driven based on, for example, an operating mode of the HPM 102, or an energy regeneration or capture operation. In some embodiments, the electric motor 104 is used to control a flow rate of the hydraulic fluid flow 110 and/or the pressure difference between the ports 106 and 108. The hydraulic fluid flow 110 may be positive or negative in accordance to the direction as shown in FIG. 1.

The HPM 102 may be considered a hydraulic pump or a hydraulic motor, depending on its operation. For example, when a rotor of the HPM 102 is driving a hydraulic fluid flow, the HPM 102 may be considered as operating as a hydraulic pump, which generates a pressure difference between the ports 106 and 108 and drives, or partially drives, the hydraulic fluid flow 110. When the rotor of the HPM 102 is being driven by the hydraulic fluid flow 110, such as in response to a pressure difference between the ports 106 and 108, the HPM 102 may be considered as operating as a hydraulic motor. In some embodiments of the device 100, the HPM 102 may periodically operate as a hydraulic pump and periodically operate as a hydraulic motor.

In some embodiments, the electric motor 104 may operate in a motor mode, in which the motor 104 increases a flow rate of the hydraulic fluid flow 110. That is, the motor 104 boosts the flow rate over the flow rate that would occur without the operation of the motor 104 in the motor mode, or without the presence of the motor 104. Additionally, the operation of the motor 104 in the motor mode may increase the pressure difference between the ports 106 and 108 in the direction of the flow.

The motor 104 may be driven in the motor mode using power received from an electrical power supply 112. The electrical power supply 112 may take any suitable form, such as a battery, an output from an electrical generator, or another suitable power supply. Systems utilizing multiple devices 100, such as those described below, may include one or more electrical power supplies for powering the motors 104.

In some embodiments, the electric motor 104 may operate in a generator mode, in which the motor 104 uses the flow rate of the hydraulic fluid flow 110 to drive a rotor of the motor 104 and generate electrical power, in accordance with conventional motors/generators. In some embodiments, charging electronics 114 use the electrical power (e.g., current) generated by the motor 104 operating in the generator mode to charge a battery 116. The electrical power generated by the motor 104 may also be stored in other forms or utilized by other electricity consuming devices using conventional techniques. Systems utilizing multiple devices 100, may include one or more charging electronics 114 and batteries 116 for storing generated electrical energy.

In some embodiments, the device 100 is used to drive linear or rotational movement of a load 120 based on the hydraulic fluid flow 110. As discussed below, this movement of the load may be driven by the HPM 102 or using an actuator 122, such as a linear actuator.

In some embodiments, the device 100 is used to capture energy from the load 120, such as when movement of the load 120 is being driven by gravity or by a renewable energy source. Here, the moving load 120 drives the hydraulic fluid flow 110, possibly using the actuator 122, which in turn may drive rotation of a rotor of the HPM 102. The energy in the hydraulic fluid flow 110 that has been transferred into the rotation of the rotor may then be converted into electrical energy using the motor 104.

Figure 2:
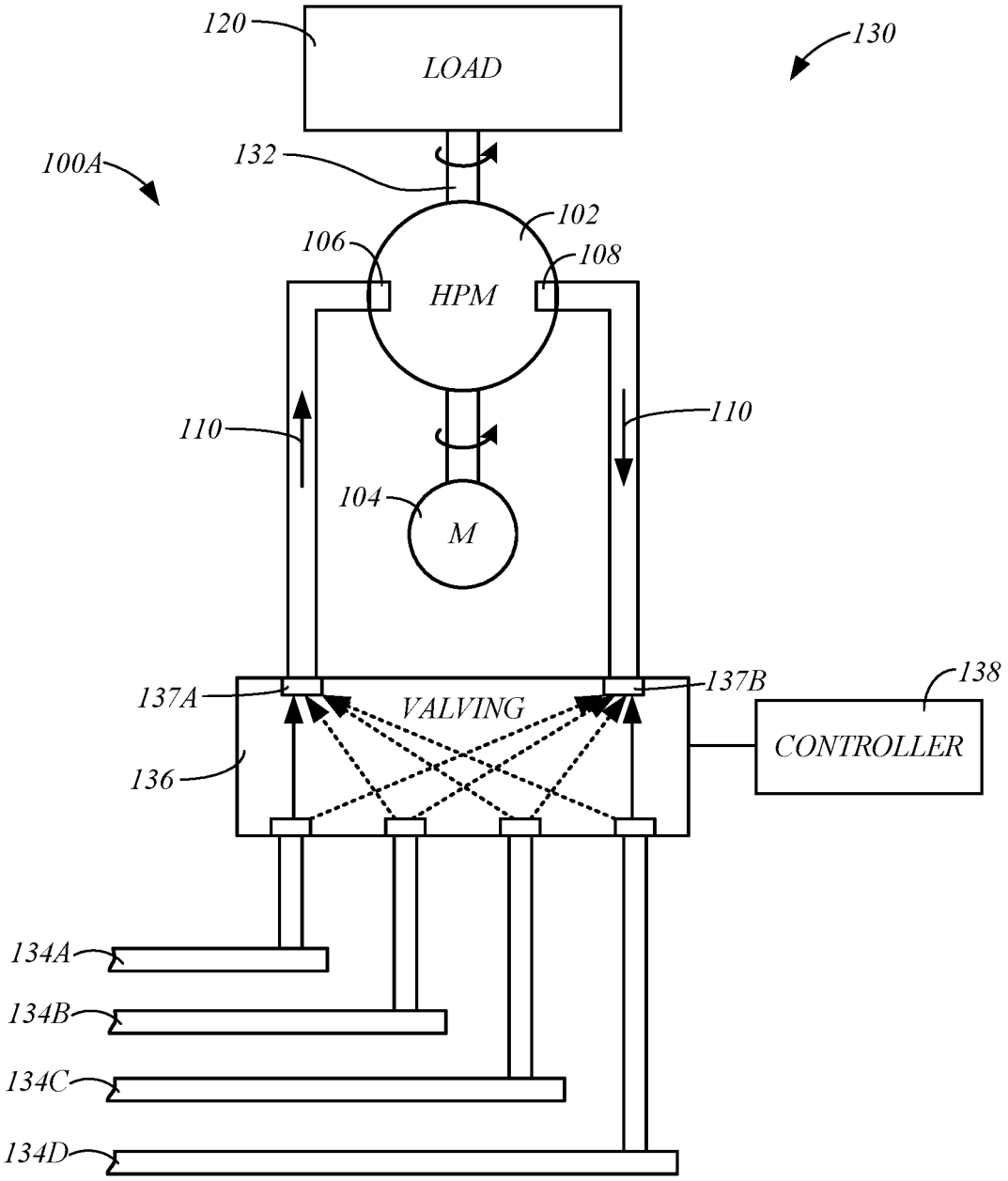
FIG. 2 is a simplified diagram illustrating an example of a system utilizing an example of the device of FIG. 1, in accordance with embodiments of the present disclosure.

FIG. 2 is a simplified diagram illustrating an example of a system 130 utilizing an example of the device 100, referred to as 100A, in accordance with embodiments of the present disclosure. In one embodiment, the load 120 is connected to a shaft 132 and is configured to rotate with rotation of the shaft 132. The rotor of the HPM 102 and the rotor of the motor 104 are also connected to the shaft 132 such that they rotate with rotation of the shaft 132. In some embodiments, gears are used to make the connections between rotations.

In some embodiments, the system 130 includes two or more pressure rails, generally referred to as 134, each containing hydraulic fluid at a different pressure than the other pressure rails 134. While four pressure rails (134A-D) are shown in FIG. 2, it is understood that embodiments of the system 130 may include only two pressure rails, three pressure rails, or more than four pressure rails.

The pressure rails 134 include a low pressure rail 134D that contains hydraulic fluid at the lowest pressure (e.g., atmospheric pressure) relative to the other pressure rails 134, such as at a low pressure corresponding to a supply of hydraulic fluid, and a high pressure rail 134A contains hydraulic fluid at the highest pressure relative to the other pressure rails 134. Any remaining pressure rails 134, such as rails 134B and 134C, each contain hydraulic fluid at a pressure that is between the pressures of the rails 134A and 134D.

If the system 130 only includes a pair of pressure rails 134, such as the high and low pressure rails 134A and 134D, the system 130 may be configured to vary the pressure of at least one of the pressure rails 134 to provide a desired pressure difference between the rails 134. When three or more pressure rails 134 are used, the pressures of the intermediary rails 134, such as rails 134B and 134C, may be set to pressures that substantially evenly space the pressure gaps between the rails, or are set to pressures that accommodate particular services to be provided by the system 130 using one or more of the devices 100. Additional options regarding the pressure rails 134 are discussed in greater detail below.

In some embodiments, the system 130 includes valving 136 having ports 137A and 137B, which are respectively connected to the ports 106 and 108 of the HPM 102. The valving 136 is configured to connect one of the pressure rails 134 to the port 137A and thus, to the first port 106 of the HPM 102, and one of the pressure rails 134 to the port 137B and thus, to the second port 108 of the HPM 102. In the example shown in FIG. 2, the valving 136 has connected (solid arrow) the pressure rail 134A to the first port 106, and the pressure rail 134D to the second port 108.

The valving 136 may take on any suitable form, and may be configured to connect any one of the pressure rails 134, including the same pressure rail 134, to the ports 106 and 108 of the HPM 102. Alternatively, the valving 136 may be configured to maintain a connection of one of the rails 134 to one of the ports 106 or 108 of the HPM 102, while allowing for other rails 134 to be selectively connected to the other port 106 or 108 of the HPM 102.

In some embodiments, a controller 138 may be used to actuate the valving 136 to connect the same pressure rails 134 or a pair of different pressure rails 134 to the ports 106 and 108 of the HPM 102. In some embodiments, the controller 138 represents one or more processors that control components of the system 130 or device 100A to perform one or more functions described herein in response to the execution of instructions stored in non-transitory memory. In some embodiments, the one or more processors of the controller are components of one or more computer-based systems, control circuits, microprocessor-based engine control systems, programmable hardware components (e.g., a field programmable gate array).

In some embodiments, the device 100A may operate in a motor mode, in which it is configured to drive rotation of the shaft 132 and the load 120. Here, the rotor of the HPM 102 drives rotation of the shaft 132 and the load 120 based on a pressure difference of the hydraulic fluid between the ports 106 and 108, which drives a hydraulic fluid flow 110 through the HPM 102. The pressure difference may be formed through the connection of the port 106 to a relatively high pressure rail, such as rail 134A, and the connection of the port 108 to a relatively low pressure rail, such as 134D, as shown in FIG. 2. In some embodiments, the pressure rail connection may be facilitated by the valving 136 and controlled by the controller 138, as discussed above.

In some embodiments, the torque applied to the shaft 132 by the hydraulic actuation of the HPM 102 motor may be precisely and quickly controlled using the motor 104. For example, the motor 104 may be operated in a motor mode, in which the motor 104 is powered by the electrical power supply (FIG. 1) 112 to increase or boost the torque applied to the shaft 132, which increases the rotational velocity of the shaft 132 and the load 120. This also increases or boosts the flow rate of the hydraulic fluid flow 110 through the HPM 102 due to the increase in the rotational velocity of the rotor of the HPM 102 over that which would have been generated solely by the pressure difference between the ports 106 and 108 of the HPM 102.

The motor 104 may also be operated in a generator mode, in which the electric motor 104 impedes the rotation of the shaft 132, thereby reducing the net torque on the shaft 132, which decreases the rotational velocity of the shaft 132 and the load 120. As a result, the generator mode of the motor 104 also decreases the flow rate of the hydraulic fluid flow 110 through the HPM 102 due to the decrease in the rotational velocity of the rotor of the HPM 102 over that which would have been generated solely by the pressure difference between the ports 106 and 108 of the HPM 102.

In some embodiments, the resulting electricity that is generated by the motor 104 while operating in the generator mode may be used to power other electrical components of the system 130. For example, the generated electrical power may be delivered to the charging electronics 114, which may use the electrical power to charge the battery 116, as indicated in FIG. 1.

In some embodiments, the torque applied to the shaft 132 by the motor 104, such as the positive torque applied by the motor 104 while operating in the motor mode or the negative torque applied by the motor 104 while operating in the generator mode, is relatively small compared to the torque applied to the shaft 132 by the HPM 102 based on the pressure difference between the ports 106 and 108. Thus, the primary torque applied to the shaft 132 is determined based on the pressures of the pressure rails 134 that are connected to the ports 106 and 108. As a result, the electric motor 104 may have a very low power relative to that which would be required by an electric motor to apply a torque to the shaft 132 that would be similar to that provided by the HPM 102.

One may consider this operation of the motor 104 as adjusting an effective pressure difference across the ports 106 and 108 of the HPM 102. That is, the combination of the torque applied to the shaft 132 by the HPM 102 based on the pressure difference between the ports 106 and 108 and the positive or negative torque to the shaft 132 by the motor 104 results in a net torque on the shaft 132. This net torque corresponds to an effective pressure difference between the ports 106 and 108 that, if applied to the ports 106 and 108 without the presence of the motor 104, would result in the net torque on the shaft. Accordingly, the motor 104 may be considered as increasing (boosting) or decreasing (bucking) the pressure difference between the ports 106 and 108 of the HPM 102 from that provided by the connected pressure rails 134 to the effective pressure difference.

One way to reduce the energy required by the motor 104 and the size of the motor 104 is to reduce the torque that must be applied by motor 104 to obtain a desired rotational velocity of the shaft 132 or the desired effective pressure difference between the ports 106 and 108. This may be accomplished by generating a pressure difference at the ports 106 and 108 using the pressure rails 134 that closely match a desired operating pressure to perform the service, such that the motor 104 must only be used to make small adjustments to the net torque that is applied to the shaft 134.

The use of multiple pressure rails 134 increases the precision that the pressure difference between the ports 106 and 108 can be matched to a desired operating pressure. Thus, in some embodiments, the valving 136 is used to select a pair of the pressure rails 134 for connection to the ports 106 and 108 that provides the desired operating pressure and minimizes the torque and power requirement of the motor 104.

The system of FIG. 2 may also be operated in a generator mode in response to rotation of the shaft 132 by the load 120 whose rotational movement may be driven by gravity or a renewable energy source. For example, the shaft 132 may be connected to a wind turbine that converts wind energy into a torque on the shaft 132. The device 100A may use the torque applied to the shaft 132 to generate hydraulic and/or electrical energy. The torque on the shaft 132 provided by the load 120 may drive rotation of the shaft 132 and a rotor of the motor 104. The motor 104, operating as a generator, generates electricity that may be stored in a battery 116 using charging electronics 114, as indicated in FIG. 1.

The HPM 102 may also be used to generate hydraulic energy in response to the rotation of the shaft 132 by the load whose rotational movement may be driven by gravity or a renewable energy source. For example, the rotation of the shaft 132 may drive the rotor of the HPM 102, which drives a hydraulic fluid flow 110. The hydraulic fluid flow 110 may be used to store the energy by pressurizing a hydraulic accumulator of the hydraulic fluid, such as a hydraulic accumulator of one of the pressure rails 134 or another container, or generate electricity by driving an electrical generator using the hydraulic fluid flow 110, for example.

Figure 3:
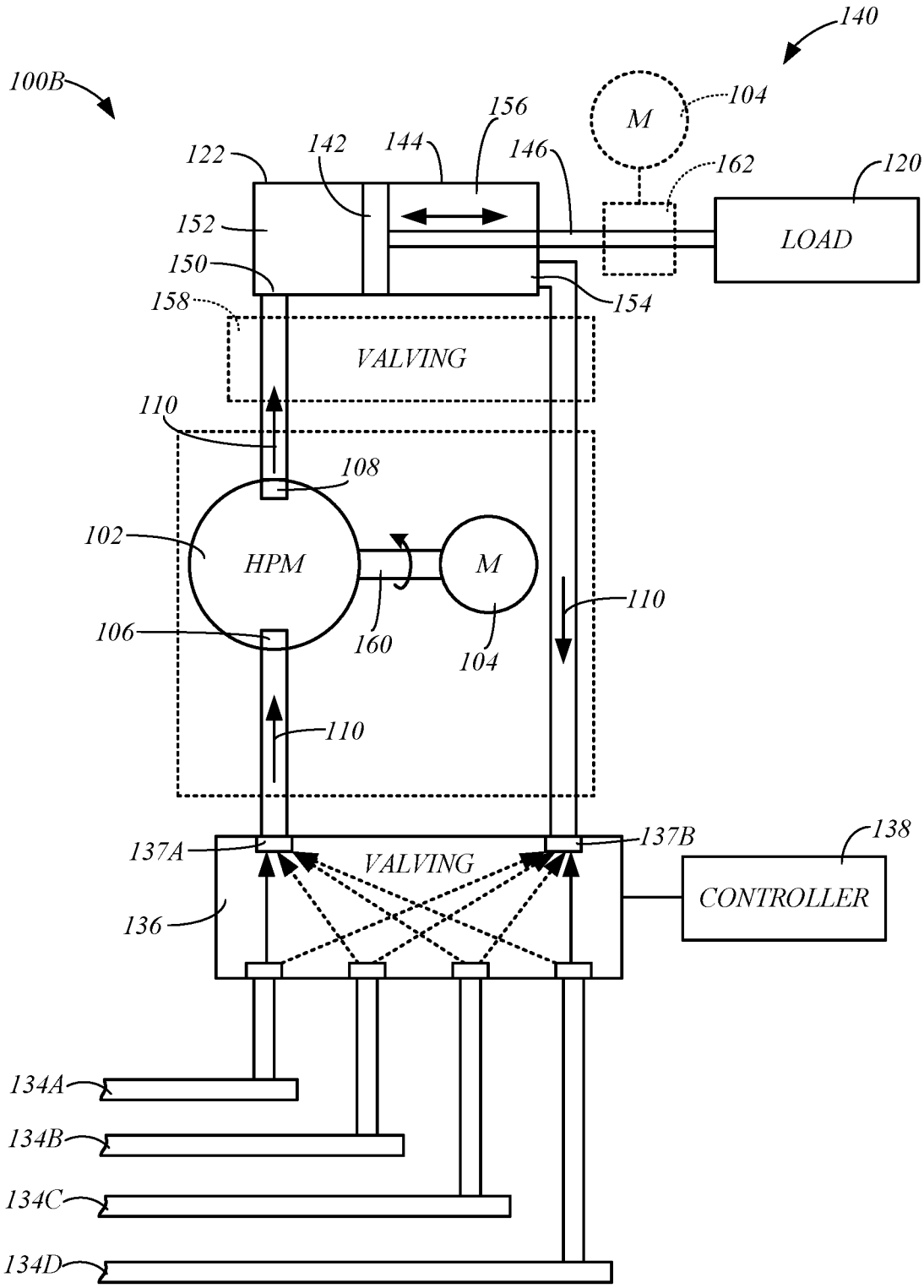
FIG. 3 is a simplified diagram illustrating an example of a system utilizing an example of the device of FIG. 1, in accordance with embodiments of the present disclosure.

FIG. 3 is a simplified diagram illustrating an example of a system 140 utilizing an example of the device 100, referred to as 100B, in accordance with embodiments of the present disclosure. The system 140 may include embodiments of the valving 136, the pressure rails 134, and/or the controller 138 and other features of the system of FIG. 2.

In one embodiment, the device 100B includes the actuator 122 in the form of a linear actuator that includes a piston 142 contained in a housing 144. A load 120 may be connected to a rod 146 of the piston 142. As with the device of FIG. 2, the device 100B may operate in a motor mode, in which the device 100B is configured to drive movement of the piston 142 relative to the housing 144 to move the load 120. In some embodiments, the device 100B may operate in a generator mode, in which the device 100B captures energy from movement of the piston 142 relative to the housing 144 that is driven by movement of the load, such as by gravity or a renewable energy source. Here, the load 120 may be generated by a wave energy converter driven by wave energy, for example.

The linear actuator housing 144 includes a port 150 to a side 152 of the piston 142, and a port 154 to a side 156 of the piston 142. One of the ports 150 and 154 is connected to the second port 108 of the HPM 102 and the other of the ports 150 and 154 is connected to a pressure rail 134. Optional valving 158 may be used to selectively connect the ports 150 and 154 to port 108 of the HPM 102 or one of the pressure rails 134. Valving 136 may also be used to connect one of the pressure rails 134 to the port 106 of the HPM 102, and one of the pressure rails 134 to one of the ports 150 or 154 of the actuator 122, such as port 154, as shown in FIG. 3.

The device 100B may operate in a motor mode, in which a hydraulic fluid flow 110 is related to a pressure difference at the ports 150 and 154 of the actuator 122 and the ports 106 and 108 of the HPM 102, which are based on a pressure difference between the connected pressure rails 134. The hydraulic fluid flow 110 may be directed into or out of the ports 150 and 154 to drive movement of the piston 142 relative to the housing 144 and, thus, movement of the load 120.

The device 100B may operate in a generator mode, in which a hydraulic fluid flow 110 is generated based on movement of the piston 142 relative to the housing 144 by movement of the load 120. The hydraulic fluid flow 110 may be driven into or out of the ports 150 and 154 based on the direction of movement of the piston 142.

In one embodiment, the motor 104 (solid lines) of the device 100B is connected to a shaft 160 that is connected to the rotor of the HPM 102. The rotor of the HPM 102 applies a torque to the shaft 160 based on the hydraulic fluid flow 110. In some embodiments, the motor 104 may operate in a motor mode, in which it is configured to apply a positive torque to the shaft 160, which increases the rotation of the shaft 160 and the rotor of the HPM 102 and increases the flow rate of the hydraulic fluid flow 110 through the HPM 102 and into one of the ports 150 and 154 of the linear actuator 122. This boosts the pressure difference at the ports 150 and 154 of the linear actuator 122 and drives movement of the piston 142 relative to the housing 140.

The motor 104 may also operate in a generator mode, in which the motor 104 impedes rotation of the shaft 160 by applying a negative torque to the shaft 160. As a result, the generator mode of the motor 104 also decreases the flow rate of the hydraulic fluid flow 110 through the HPM 102 and into one of the ports 150 and 154 of the linear actuator. In some embodiments, the resulting electricity that is generated by the motor 104 while operating in the generator mode may be used to power other electrical components of the system 140. For example, the generated electrical power may be delivered to the charging electronics 114, which may use the electrical power to charge the battery 116, as indicated in FIG. 1.

The HPM 102 may also be used to generate hydraulic energy in response to the rotation of the shaft 160 in response to movement of the load 120 by gravity or a renewable energy source. For example, the rotation of the shaft 160 may drive the rotor of the HPM 102, which drives a hydraulic fluid flow 110. The hydraulic fluid flow 110 may be used to store the energy by pressurizing a container of the hydraulic fluid, such as one of the pressure rails 134 or another container, or generate electricity by driving an electrical generator using the hydraulic fluid flow 110, for example.

In some embodiments, the motor 104 (phantom lines) of the device 100B may be attached to the rod 146 of the piston 142 through a suitable device 162 that translates rotary motion to linear motion. Here, the motor 104 may operate in a motor mode, in which it applies a force to the piston 142 through the rod 146 to increase the flow rate of the hydraulic fluid flow 110 into or out of the ports 150 and 154 of the linear actuator 122 and through the HPM 102. The motor 104 (phantom lines) may also operate in a generator mode, in which it impedes movement of the piston 142 and decreases the flow rate of the hydraulic fluid flow 110 into or out of the ports 150 and 154 of the linear actuator 122 and through the HPM 102. The resulting electricity that is generated by the motor 104 (phantom lines) while operating in the generator mode may be used to charge a battery or power other electrical components of the system, as discussed above.

While the device 100B operates in the motoring mode, the electric motor 104 (solid or phantom lines) may be used to precisely control the flow rate of the hydraulic fluid flow 110 and/or the movement of the piston 142 relative to the housing 144 through its operation in the motor or generator mode. Thus, while hydraulic power may be used to provide the bulk of the power used to move the load 120, fine adjustments may be made using the electric motor 104 to precisely control the actuation of the load 120 by the linear actuator 122. This allows the motor 104 to be configured to generate a small amount of power relative to the hydraulic power produced using the pressure rails 134 and the HPM 102. Moreover, the use of multiple pressure rails 134 allows for greater control of the hydraulic power applied to the linear actuator 122 while minimizing the power needed from the motor 134.

Figure 4:
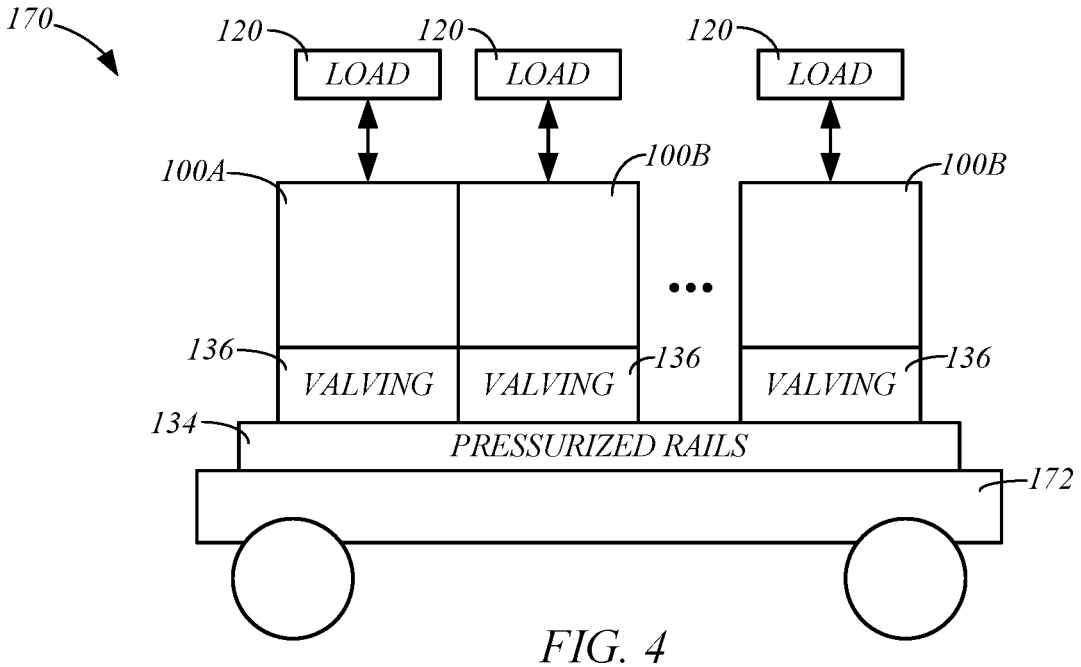
FIG. 4 is a simplified diagram of a system in accordance with embodiments of the present disclosure.

Embodiments of the present disclosure are also directed to a system 170 that includes one or more of the devices 100, such as the devices 100A and/or 100B, such as shown in the simplified diagram of FIG. 4. Thus, the system 170 may include one or more of the devices 100A, and/or one or more of the devices 100B. Each of the devices 100 may include valving 136 for coupling appropriate pressure rails 134 to the HPM 102 of the device 100A, or to the HPM 102 and the linear actuator 122 of the device 100B. Each of the devices 100 may be used to drive rotational or linear movement of a load 120 while operating in a motor mode, and/or recover energy from a rotating or linearly moving load 120 while operating in a generator mode.

Additionally, the system 170 may be carried or supported on a mobile vehicle 172, as indicted in FIG. 4. For example, the system may be used to drive degrees of freedom of components of excavators, wheel-loaders, skid steer-loaders, mowers, and other off-highway vehicles. For example, an excavator may use the device 100A of FIG. 2 to rotate a cab of the excavator, while devices 100B of FIG. 3 may be used to actuate boom, dipper and/or a bucket of the excavator.

The system 170 may be used as a renewable energy capture device, such as a wave energy converter, or a power-take-off device for a wave energy capture system. For example, the system 170 may be used to capture and transmit energy from the motions of multiple wave energy converters. For example, the power-take-off device may use the device 100B in FIG. 3 to capture the energy from a linear actuator connected a wave energy converter, so that the hydraulic energy in the fluid flow from the pressure rails 134 can be used to generate electricity using the electric generator 186 in FIG. 4.

Figure 5:
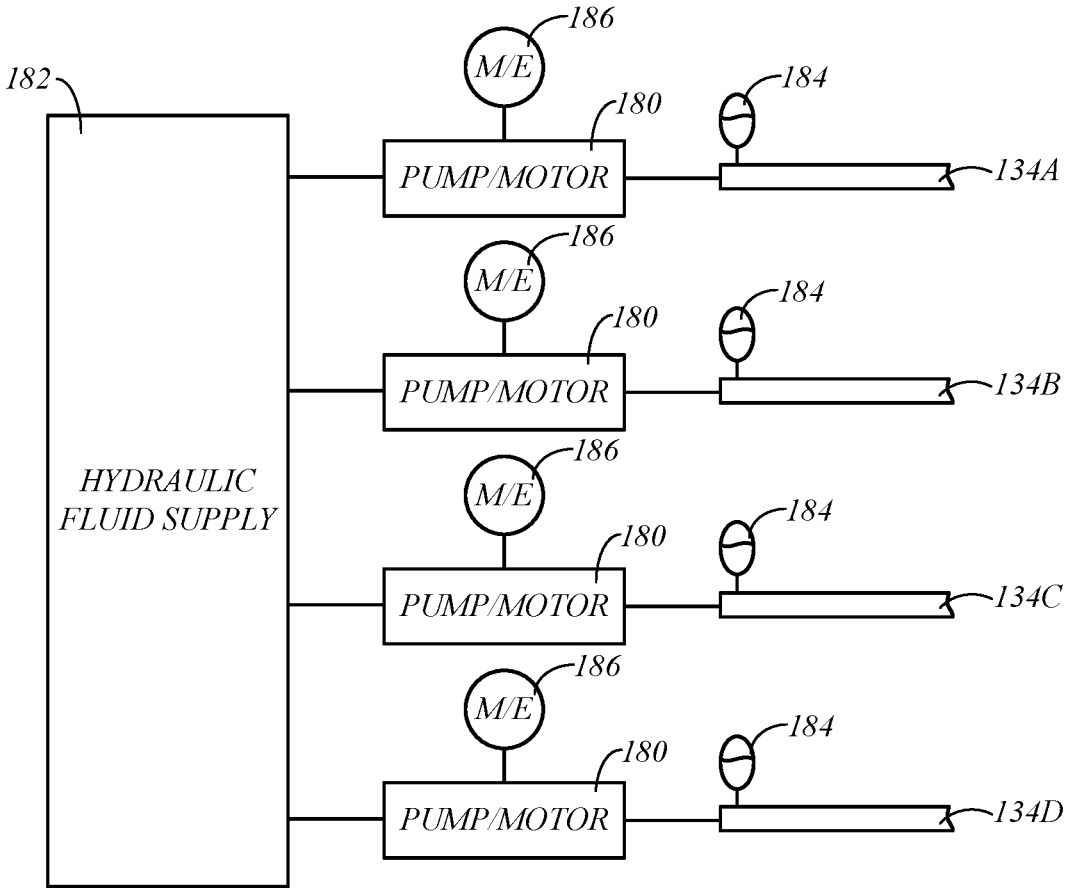
FIGS. 5 and 6 are simplified diagrams illustrating examples of techniques that may be used to pressurize two or more pressure rails, in accordance with embodiments of the present disclosure.
Figure 6:
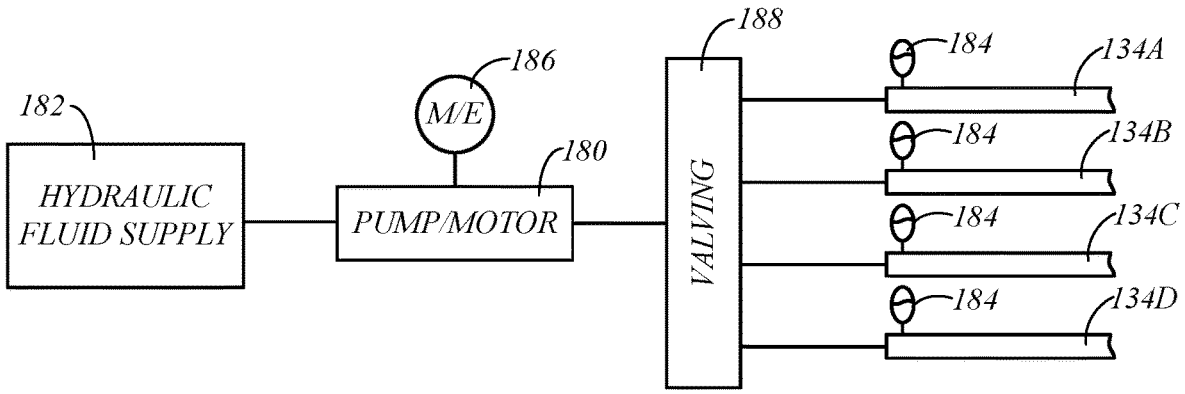

FIGS. 5 and 6 are simplified diagrams illustrating examples of techniques that may be used to pressurize the two or more pressure rails 134. In FIG. 5, a hydraulic pump/motor 180, such as a fixed or displacement pump, may be provided for each pressure rail 134 to drive hydraulic fluid from a hydraulic fluid supply 182 to the corresponding pressure rail 134. Each pressure rail 134 may include an accumulator 184 to maintain a supply of the hydraulic fluid at a desired pressure. Each pump/motor 180 may be driven using an electrical motor or a combustion engine 186, such as the engine of a mobile vehicle, for example.

Alternatively, a single hydraulic pump/motor 180, such as a fixed displacement pump, may be used to drive hydraulic fluid from the supply 182 to each of the pressure rails 134 through valving 188, as shown in FIG. 6. That is, the valving 188 may be used to direct a flow of hydraulic fluid from the supply 182 generated by the hydraulic pump/motor 180 to one of the pressure rails 134 at a time.

The multiple hydraulic pump/motors 180 of FIG. 5 or the single hydraulic pump/motor 180 of FIG. 6 may also be used to convert hydraulic fluid flows from the pressure rails 134 to the hydraulic fluid supply 182 into electricity. Such a hydraulic fluid flow may be used by the electric motor 186 operating in a generator mode to generate electricity, which may be stored in a battery, as discussed above, or used to power electrical components.

The devices 100 and systems described above provide significant advantages over the techniques that rely solely on hydraulic power or solely on electrical power to drive movement or capture power of a load either linearly or rotationally. The disclosed architectures of the device combine electrical actuation and hydraulic actuation in a complementary manner to simultaneously improve efficiency, performance and compactness. Previous approaches have focused on the power source as exclusively hydraulic or electric. By combining them, the limitation of each actuation approach can be avoided, while providing significant efficiency improvements.

The device 100 in accordance with embodiments of the present disclosure may avoid the use of throttle valves and be regenerative. It can be highly modular and applicable to many machines. It retains the benefits of centralized hydraulic power generation in the pressure rails that a hydraulic transformer approach features: better component utilization, better engine management, and efficient generation of hydraulic power. The device 100 can be formed significantly more compact than a hydraulic transformer, as only a single fixed displacement pump/motor 102 and a small electric drive 104 are needed (instead of two variable displacement pump/motors). The power density advantage of the device 100 becomes even greater if the device is integrated and designed to operate at high speeds. The overall efficiency of the device 100 is also expected to be significantly higher than the hydraulic transformer approach. This is due to the electric motor 104 of the device 100 being inherently more efficient as well as being able to operate the HPM 102 at full (fixed) displacement.

The device 100 in accordance with embodiments of the present disclosure also retains the control performance and efficiency benefits of a conventional electro-hydraulic actuator, but with the majority of power supplied hydraulically by the pressure rails. Hence, the required power rating for the electric motor 104 is reduced. By tightly integrating the electric motor 104 and the HPM 102 in the device 100, benefits from both the component and system levels accrue. Component level benefits include: 1) reducing mechanical friction through fewer bearings and elimination of shaft seals; 2) reducing energy conversion losses through reducing the number of energy conversion stages; 3) improved power density of the electric motor and motor drive electronics enabled by hydraulic cooling of the electric components, and 4) improved control response by reducing the rotational inertia of the integrated rotor-pump. Systems level benefits include a) eliminating redundant components such as casings, bearings and rotors, leading to lighter and more compact packaging; b) lower friction allows the integrated module to operate at a much higher speed and lower torque regime without sacrificing efficiency. All of these contribute to increasing the overall power density as both the electric motor 104 and the HPM 102 can be downsized.

The device 100 in accordance with embodiments of the present disclosure also provides for the flexibility to transmit power and store energy either hydraulically (via the pressure rails and hydraulic accumulators) or electrically (via batteries). Valving may be used to allow the device to switch between different configurations. As each configuration has its own best operating region, this flexibility and redundancy can be exploited to increase the overall efficiency and system sizing.

Although the embodiments of the present disclosure have been described with reference to preferred embodiments, workers skilled in the art will recognize that changes may be made in form and detail without departing from the spirit and scope of the present disclosure.

What is claimed is:

1. A device having a hybrid hydraulic-electric architecture comprising:
- a hydraulic pump/motor having first and second ports;
- an electric motor;
- two or more pressure rails, each pressure rail containing hydraulic fluid at a different pressure; and
- valving configured to connect any one of the pressure rails to the first port,
- wherein:
  - a hydraulic fluid flow is driven through the hydraulic pump/motor based on a pressure difference between the first and second ports; and
  - the electric motor is configured to control a flow rate of the hydraulic fluid flow.

2. The device of claim 1, wherein:
- a power of the hydraulic fluid flow is defined by the product of the pressure difference and a flow rate of the hydraulic fluid flow; and
- the electric motor includes:
  - a motor mode, in which the electric motor increases the power; and
  - a generator mode, in which the electric motor decreases the power.

3. The device of claim 1, wherein the valving is configured to connect any one of the pressure rails to a first port of the valving, and connect any one of the pressure rails to a second port of the valving, wherein the first port of the valving is connected to the first port of the hydraulic pump/motor.

4. The device of claim 3, wherein the valving is configured to selectively connect any one of the pressure rails to the first port of the hydraulic pump/motor and the same or a different one of the pressure rails to the second port of the hydraulic pump/motor.

5. The device of claim 3, wherein the second port of the hydraulic pump/motor is coupled to the second port of the valving.

6. The device of claim 2, wherein:
- the device includes a linear actuator comprising a piston contained in a housing; and
- the hydraulic fluid flow drives, or is driven by, movement of the piston relative to the housing.

7. The device of claim 2, further comprising:
- a supply of hydraulic fluid; and
- at least one pump configured to drive an output flow of the hydraulic fluid from the supply to at least one of the pressure rails.

8. The device of claim 1, wherein:
- the hydraulic pump/motor is connected to a shaft, which rotates in accordance with the hydraulic fluid flow; and
- the electric motor is connected to the shaft and includes:
  - a motor mode, in which the electric motor drives rotation of the shaft; and/or
  - a generator mode, in which the electric motor impedes rotation of the shaft.

9. The device of claim 1, wherein:
- the hydraulic pump/motor comprises a linear hydraulic actuator including a piston contained in a housing;
- the hydraulic fluid flow drives, or is driven by, movement of the piston relative to the housing; and
- the electric motor includes at least one of:
  - a motoring mode, in which the electric motor drives movement of the piston relative to the housing; and
  - a generator mode, in which the electric motor impedes movement of the piston relative to the housing.

10. The device of claim 1, further comprising:
- a hydraulic motor configured to drive rotation of a shaft using the hydraulic fluid flow; and
- a generator configured to generate electrical energy in response to rotation of the shaft.

11. A mobile vehicle comprising the device of claim 1.

12. A renewable energy capture device comprising the device of claim 1.

13. The device of claim 1, wherein the two or more pressure rails comprises three or more pressure rails.

14. A hydraulic system comprising:
- two or more pressure rails, each containing hydraulic fluid at a different pressure than the other pressure rails;
- a first device comprising:
  - a first hydraulic pump/motor having first and second ports; and
  - a first electric motor; and
- first valving configured to connect any one of the pressure rails to a first port of the first valving, and connect any one of the pressure rails to a second port of the first valving, wherein the first port of the first valving is connected to the first port of the first hydraulic pump/motor,
- wherein:
  - a first flow of hydraulic fluid from one of the pressure rails is driven through the first hydraulic pump/motor based on a first pressure difference between the first and second ports of the first hydraulic pump/motor,
  - a first power of the first flow is defined by the product of the first pressure difference and a flow rate of the first flow; and
  - the first electric motor is configured to control a flow rate of the first flow and/or the first pressure difference, and the first electric motor includes:
    - a motor mode, in which the first electric motor increases the first power; and/or a generator mode, in which the first electric motor decreases the first power.

15. The system of claim 14, wherein:

the first hydraulic pump/motor drives rotation of a shaft in response to the first flow;

the first electric motor is connected to the shaft;

when the first electric motor is in the motor mode, the first electric motor drives rotation of the shaft; and when the first electric motor is in the generator mode, the first electric motor impedes rotation of the shaft.

16. The system of claim 14, wherein:

the first hydraulic pump/motor comprises a linear hydraulic actuator including a piston contained in a housing;

the first flow of hydraulic fluid drives, or is driven by, movement of the piston relative to the housing;

when the first electric motor is in the motor mode, the first electric motor drives movement of the piston relative to the housing; and when the first electric motor is in the generator mode, the first electric motor impedes movement of the piston relative to the housing.

17. The system of claim 14, wherein:

the device includes a linear actuator comprising a piston contained in a housing; and the first flow drives, or is driven by, movement of the piston relative to the cylinder.

18. The system of claim 14, wherein:

the system includes a second device comprising:

a second hydraulic pump/motor having first and second ports;

a second electric motor; and second valving configured to connect any one of the pressure rails to a first port of the second valving, and connect any one of the pressure rails to a second port of the second valving, wherein the first port of the second valving is connected to the first port of the second hydraulic pump/motor;

a second flow of hydraulic fluid from one of the pressure rails is driven through the second hydraulic pump/motor based on a second pressure difference between the first and second ports of the second hydraulic pump/motor, a second power of the second flow is defined by the product of the second pressure difference and a flow rate of the second flow; and the second electric motor is configured to control a flow rate of the second flow and/or the second pressure difference, and the second electric motor includes:

a motor mode, in which the second electric motor increases the second power; and/or a generator mode, in which the second electric motor decreases the second power.

19. The system of claim 14, wherein the two or more pressure ails comprises three or more pressure rails.

20. A method of operating a system comprising:

two or more pressure rails, each containing hydraulic fluid at a different pressure than the other pressure rails; and a device comprising:

a hydraulic pump/motor having first and second ports;

an electric motor; and valving configured to connect any one of the pressure rails to a first port of the valving, and connect any one of the pressure rails to a second port of the valving, wherein the first port of the valving is connected to the first port of the hydraulic pump/motor, the method comprising:

driving a hydraulic fluid flow from one of the pressure rails through the hydraulic pump/motor based on a pressure difference between the first and second ports of the hydraulic pump/motor; and controlling a flow rate of the hydraulic fluid flow and/or the pressure difference using the electric motor comprising:

operating the electric motor in a motor mode, in which the electric motor increases a power of the hydraulic fluid flow; and/or operating the electric motor in a generator mode, in which the electric motor decreases the power of the hydraulic fluid flow, wherein the power of the hydraulic fluid flow is defined by the product of the pressure difference and a flow rate of the hydraulic fluid flow.

* * * * *